US011162376B2

(12) United States Patent
Stiehler

(10) Patent No.: US 11,162,376 B2
(45) Date of Patent: Nov. 2, 2021

(54) GUIDE VANE PLATE WITH A CHAMFERED AND A CYLINDRICAL EDGE REGION

(71) Applicant: MTU Aero Engines AG, Munich (DE)

(72) Inventor: Frank Stiehler, Bad Liebenwerda (DE)

(73) Assignee: MTU Aero Engines AG, Munich (DE)

( * ) Notice: Subject to any disclaimer, the term of this patent is extended or adjusted under 35 U.S.C. 154(b) by 189 days.

(21) Appl. No.: 15/452,513

(22) Filed: Mar. 7, 2017

(65) Prior Publication Data

US 2017/0268356 A1 Sep. 21, 2017

(30) Foreign Application Priority Data

Mar. 16, 2016 (DE) ..... 10 2016 204 291

(51) Int. Cl.

| | |
|---|---|
| ***F01D 9/04*** | (2006.01) |
| ***F01D 17/16*** | (2006.01) |
| ***F04D 29/56*** | (2006.01) |
| ***F04D 29/64*** | (2006.01) |

(52) U.S. Cl.

CPC ..... *F01D 9/041* (2013.01); *F01D 17/162* (2013.01); *F04D 29/563* (2013.01); *F04D 29/644* (2013.01); *F05D 2220/32* (2013.01); *F05D 2220/36* (2013.01); *F05D 2230/60* (2013.01);

(Continued)

(58) Field of Classification Search

CPC ..... F01D 5/143; F01D 5/145; F01D 17/162; F01D 17/16; F01D 9/041; F05D 2220/36; F05D 2250/192; F05D 2220/32; F05D 2230/60; F05D 2240/12; F05D 2250/73;

(Continued)

(56) References Cited

U.S. PATENT DOCUMENTS 2,950,084 A * 8/1960 Perry ..... A41D 31/00 415/160

4,231,703 A 11/1980 Weiler (Continued)

FOREIGN PATENT DOCUMENTS

DE 3831692 A1 3/1989

DE 102012220249 * 5/2010 ..... F01D 5/143

(Continued)

OTHER PUBLICATIONS

Wikipedia, Cylinder (Geometry); https://de.wikipedia.org/wiki/Zylinder_(Geometrie); Page last edited on Oct. 17, 2017, at 04:17.

*Primary Examiner* — Charles G Freay
*Assistant Examiner* — Chirag Jariwala
(74) *Attorney, Agent, or Firm* — Barlow, Josephs & Holmes, Ltd.; David R. Josephs

(57) ABSTRACT

A guide vane according to the invention for a guide vane ring of a turbomachine has a vane element as well as a guide vane plate for its support on an inner ring. The guide vane plate has a cover surface facing the vane element, a base surface lying opposite to the cover surface, and an edge surface joining the cover and base surfaces. In a first region, the edge surface forms a chamfer of the vane plate, and in a second region, which forms the edge of a sector of the guide vane plate that is different from that of the first region, the edge surface runs along a cylindrical surface. A method comprises inserting a plurality of guide vanes according to the invention into respective uptakes in an inner ring.

8 Claims, 1 Drawing Sheet

Figure 1:
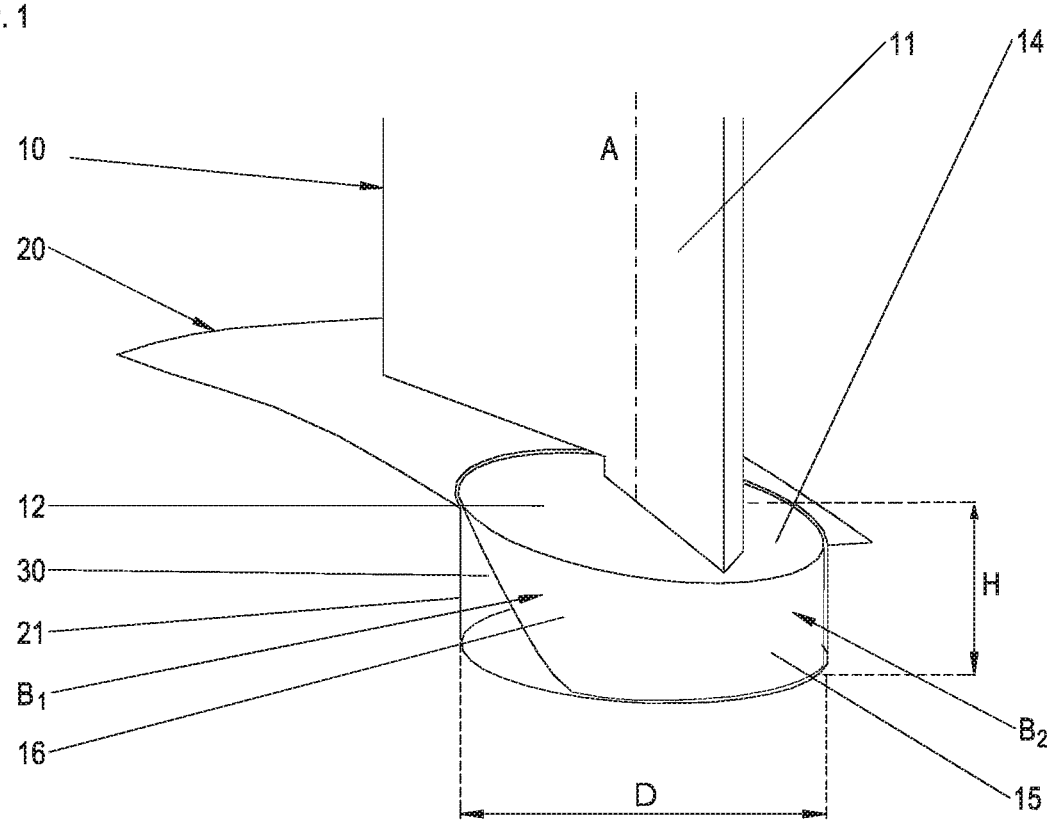

(52) U.S. Cl.
CPC .... *F05D 2240/80* (2013.01); *F05D 2250/192* (2013.01); *F05D 2250/71* (2013.01)

(58) Field of Classification Search
CPC ..... F05D 2240/80; F05D 2250/71; F04D 29/563; F04D 29/644
USPC ..... 415/159–162
See application file for complete search history.

(56) References Cited

U.S. PATENT DOCUMENTS 5,277,544 A * 1/1994 Naudet ..... F04D 29/563 415/160
6,179,559 B1 1/2001 Weaver
6,283,705 B1 * 9/2001 Rice ..... F01D 17/162 415/160
7,806,652 B2 * 10/2010 Major ..... F04D 29/563 415/160
8,668,445 B2 * 3/2014 Crespo ..... F01D 17/162 415/160
2004/0109762 A1 6/2004 Hidalgo et al.
2010/0232936 A1 * 9/2010 Mielke ..... F01D 17/162 415/160
2011/0293406 A1 * 12/2011 Abadie ..... F01D 17/162 415/160
2012/0282088 A1 * 11/2012 Stiehler ..... F04D 29/644 415/209.2
2013/0195651 A1 8/2013 Dube et al.
2014/0234087 A1 * 8/2014 Marshall ..... F01D 21/045 415/160
2016/0298477 A1 * 10/2016 Guemmer ..... F01D 5/021
2017/0159471 A1 * 6/2017 Albers ..... F01D 11/003
2017/0191367 A1 * 7/2017 Sak ..... F04D 29/563

FOREIGN PATENT DOCUMENTS

DE 102009004933 A1 7/2010
EP 2696041 A1 2/2014
EP 2884055 A1 6/2015
GB 2204364 A 11/1988

* cited by examiner

GUIDE VANE PLATE WITH A CHAMFERED AND A CYLINDRICAL EDGE REGION

BACKGROUND OF THE INVENTION

The invention relates to a guide vane for a guide vane ring of a turbomachine, a guide vane ring for a turbomachine, and a method for assembling a guide vane ring.

For establishing optimal operating conditions, turbomachines such as aircraft engines and stationary gas turbines often have, on the compressor side, at least one row of guide vanes having a plurality of guide vanes. Together with an inner ring the row of guide vanes forms a so-called guide vane ring. In this case, the guide vanes are preferably pivotable around their longitudinal axis.

A radially outer support of the guide vanes on a housing or a housing part as well as a pivoting of the guide vanes can be provided via an outer vane plate at the guide vanes and, if needed, adjusting pins or journals for each vane connecting thereon, these pins being inserted into uptakes in the housing associated with them and being able to interact with a corresponding adjustment device on the outer housing.

The inner ring preferably has a plurality of uptakes extending in the radial direction, into each of which a guide vane plate of a guide vane is inserted or can be inserted. This type of (inner) guide vane plate serves as a stabilizer or a radially inner support of the guide vanes; the terms "radial" and "axial" in this document—as long as nothing is indicated to the contrary—always refer to a central geometric axis of the inner ring, which is not always specifically stated for better readability. On the side lying opposite to the guide vane, a guide vane plate can have a bearing journal, and the uptake can be equipped for the purpose of taking up the bearing journal together with an associated bushing. Preferably introduced at the inner ring is a seal support that is provided with sealing elements or abradable or run-in layers, for which sealing fins lie opposite on the rotor side.

The guide vanes are usually assembled on the inner ring after the outer vane plate and associated adjusting journals of the guide vanes have been pre-mounted on the housing. The inner guide vane plate in this situation can be inserted or threaded into the uptakes of the inner ring; there are different concepts for the configuration of the inner ring: in particular, the inner ring can comprise two partial rings to be assembled in the axial direction and/or the inner ring can be divided into ring segments.

Partial rings to be assembled in the axial direction in this case are disadvantageous with respect to the stability of the inner ring. Due to the separating joints extending over the periphery of the inner ring, they also adversely affect an accurate positioning of sealing elements or abradable or run-in layers and promote leakage.

Therefore, so-called "integral" inner rings that are undivided in the axial direction and that form monolithic mounts of individual uptakes are frequently preferred. These types of inner rings can be divided into two or more ring segments; advantageously, there is, e.g., a division into two half-ring segments.

Suitably shaped inner guide vane plates thus make possible or simplify a threading of the respective guide vanes into such an inner ring. In particular, a guide vane having an inner guide vane plate, on the peripheral side of which a chamfer is formed, is known from the publication DE 10 2009 004 933 A1; when the guide vane plate is inserted into a circular-cylindrically shaped uptake, this permits a slightly oblique positioning of the guide vane opposite to the inner ring, which can be placed under tension for the threading and, in this case, can be extensively curved temporarily locally vis-a-vis its normal shape.

Such a chamfer, however, also brings about a relatively large cavity between a guide vane plate that is inserted and the wall of the uptake; such a cavity in turn can particularly promote a disadvantageous leakage in unfavorable support positions of the guide vane.

SUMMARY OF THE INVENTION

The object of the present invention is to provide a technique that makes possible a simple assembly of a guide vane ring and in this way minimizes the susceptibility to leakage.

The object is achieved by a guide vane, a guide vane ring, and a method of the present invention. Advantageous embodiments are disclosed in the figures, and the description herein.

A guide vane according to the invention for a guide vane ring of a turbomachine comprises a vane element as well as a guide vane plate, with which the guide vane can be supported (preferably in a pivotable manner) on an inner ring. The guide vane plate has a cover surface facing the vane element, a base surface lying opposite to the cover surface, and an edge surface joining the cover and base surfaces. In a first region, the edge surface forms a chamfer of the guide vane plate, while in a second region it runs along (a section) of a peripheral cylindrical surface. The first region of the edge surface forms an edge of a sector of the guide vane plate that is different from the second region; when the guide vane plate is rotated along the edge (or the edge surface) of the guide vane, it passes through the first and the second regions, one after the other. In particular, the guide vane plate is thus formed in an asymmetrical rotational manner (referred to a longitudinal axis of the guide vane).

For example, the edge surface can be designed as smooth (thus without edge parts) or can be assembled from two or more surfaces that can be separated from one another by at least one edge part.

The chamfer is preferably formed so that the guide vane plate tapers from the cover surface to the base surface; in particular, the base surface is preferably smaller than the cover surface. According to a preferred embodiment, the cover surface and the edge surface abut each other at an edge that is designed as an ellipse or (in fact) as a circle.

The inclination brought about by the chamfer makes possible an insertion of the guide vane in an inclined state into an associated uptake in the inner ring; the latter preferably has a size adapted to the cover surface of the guide vane plate (so that after an insertion of the guide vane plate, there is preferably a gap having a width of at most 0.5 mm, preferably at most 0.3 mm) between the cover surface thereof and a radially outer surface of the inner ring. The uptake is preferably circular-cylindrical or is formed as a section of a straight circular cylinder.

Based on the respective chamfer, the guide vane plates even of a plurality of guide vanes that are pre-mounted on the outer housing and arranged radially (with respect to the inner ring), can be sunk into the respective uptakes, since a precisely vertical insertion can be dispensed with. Nevertheless, according to the invention, the leakage between the uptake and the inserted guide vane plate will be kept small, since the chamfer is formed only in a partial region of the periphery of the guide vane plate (which is called the "first" region in this document): In another partial region (which is called here the "second" region), the edge surface runs along the cylindrical surface of a cylinder, preferably a straight circular cylinder. In the direction parallel to the longitudinal axis of the guide vane, the second region preferably extends from the cover surface to the base surface. In particular, the second region of the edge surface of a guide vane plate of a guide vane according to the invention preferably comprises straight pieces that run parallel to the longitudinal axis of the guide vane; for example, the edge surface in the second region can be perpendicular to the base surface. This second region is equipped for the purpose of snuggling the guide vane plate to the wall (forming a cylindrical surface) of an uptake of an inner ring (which can be fabricated, e.g., by way of a borehole) after the guide vane has been inserted into the uptake, which minimizes the leakage in this region.

A guide vane ring according to the invention comprises an inner ring as well as at least one guide vane according to the invention according to one of the embodiments disclosed in this document. The inner ring in this case is preferably integral, thus having a plurality of uptakes, each one for a guide vane plate, that is formed in a monolithic component (e.g., as a borehole) in each case. The inner ring may comprise two or more ring segments.

According to an advantageous embodiment of a guide vane ring according to the invention, the edge surface of the at least one guide vane plate in the second region is snuggled flat against the wall of the associated uptake; in this document, "flat snuggling" is understood to mean an essentially conforming course of the surfaces in contact with one another or at a distance of at most 0.5 mm, preferably at most 0.3 mm.

A method according to the invention serves for assembling a guide vane ring. It comprises an insertion (or threading) of a plurality of guide vanes (preferably of the same type) according to the invention into respective uptakes in an inner ring. The guide vanes are each designed according to one of the embodiments disclosed in this document. During the insertion, the guide vanes and the respective uptakes are temporarily inclined against one another, so that the base surface of the associated guide vane plate to be inserted (on the side facing away from the vane element) is temporarily oblique relative to the bottom surface of the uptake (the bottom surface bounding the uptake radially inward). The inclination can be produced by local deformation of the inner ring or by deflection of the respective guide vane pre-mounted in the housing.

According to an advantageous embodiment, the first region of the edge surface of the respective guide vane plate (that has a chamfer) projects further (radially) into the uptake in the inclined position than the second region formed along a cylindrical surface; alternatively, in contrast, the second region of the edge surface can project further into the uptake than the first region.

The threading or insertion thus preferably comprises a phase in which an edge between the base surface of the guide vane plate and the edge surface is sunk into the intake in the first region (alternatively in the second region), while (simultaneously) an (e.g., opposite-lying) edge between the cover surface and the edge surface in the second region (alternatively in the first region) projects outside (or above) the uptake beyond the radially outer inner ring surface. After this, the base surface of the guide vane plate can be placed flat onto the bottom surface of the uptake by means of a rotational movement of the uptake and the guide vane against each other, and thus the insertion process can be concluded.

A particularly efficient execution makes possible an embodiment in which all guide vanes are sequentially or simultaneously uniformly and/or in the same way inclined opposite their respective uptake.

According to an advantageous embodiment of the present invention, the edge surface in the first region has an angle of rotation that lies in a range of 20° to 170° (thus, at least 20° and at most 170°). In this case, the angle around which the edge surface rotates the longitudinal axis of the guide vane (being arranged or is arranged radially with respect to the inner ring) in a cross section (orthogonal to the longitudinal axis) is called the "angle of rotation". An angle of rotation in such a region makes possible, on the one hand, a simple insertion of the guide vane plate into a corresponding uptake, and on the other hand, a disadvantageous leakage is reduced due to the upper limit for the angle of rotation.

In the second region, the edge surface preferably has an angle of rotation (defined analogously to the one defined above) of at least 180°. The second region of the edge surface thus comprises a circular arc that has an angle of at least 180° as a central point angle. The edge surface of at least one half of the guide vane plate thus runs along a cylindrical surface, which makes possible a small leakage relative to an associated uptake in the inner ring (which is also formed as a cylinder) in the assembled state.

According to an advantageous embodiment, the cover surface of the guide vane plate has a diameter that is larger than an (average) thickness of the guide vane plate, i.e., than an (average) dimension of the guide vane plate in the direction of the longitudinal axis of the guide vane (e.g., a length of a segment of the longitudinal axis of the guide vane running between the cover surface and base surface in the guide vane plate).

A bearing journal extending in the longitudinal direction of the guide vane can be arranged on the side of the guide vane plate (at its base surface) facing away from the vane element. Such a bearing journal is preferably shaped essentially as a straight circular cylinder, the base surface thereof having a diameter that is smaller than the diameter of the cover surface of the guide vane plate. Particularly preferred is an embodiment, in which the diameter of the base surface of the circular-cylindrically shaped bearing journal is smaller than its height, preferably at most ⅔ of the height. Therefore, a particularly stable support of the guide vane in a corresponding uptake of the inner ring can be achieved.

BRIEF DESCRIPTION OF THE DRAWING FIGURES

Preferred embodiment examples of the invention based on drawings will be explained in more detail in the following. It is understood that individual elements and components can also be combined in other ways than what is shown. Reference numbers for elements corresponding to one another are used in an overlapping way in the figures and are not newly described for each figure.

Figure 2:
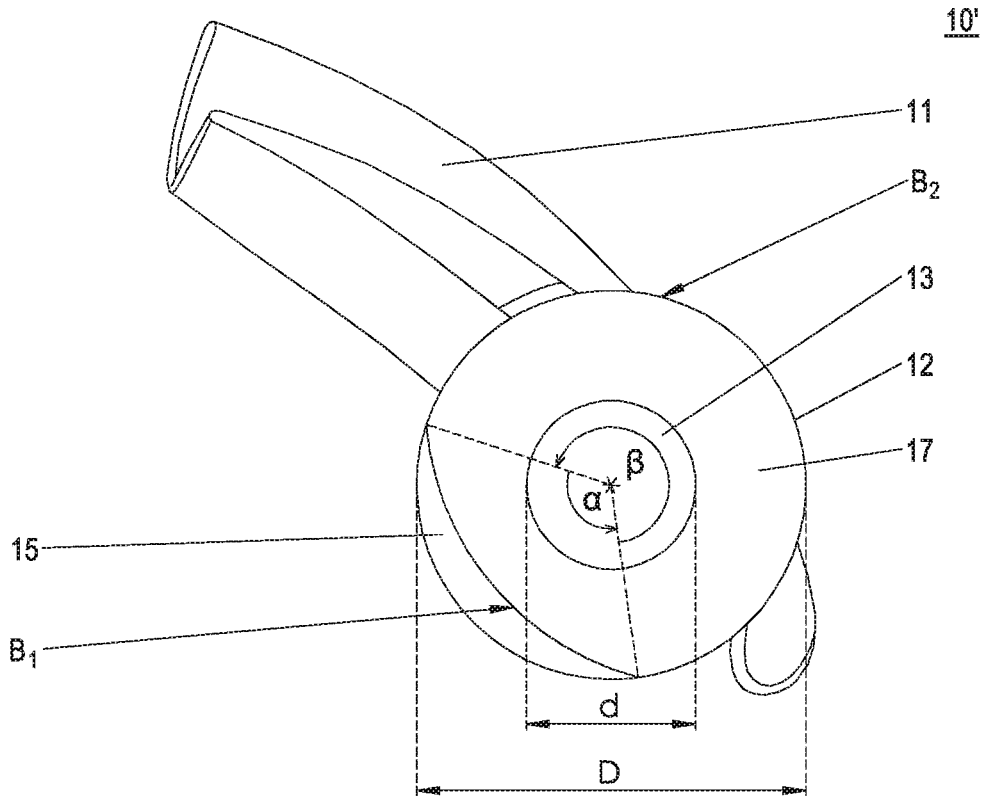

Herein, shown schematically:

FIG. 1: a part of a guide vane with an inner guide vane plate according to the invention and FIG. 2: a guide vane according to the invention, considered from the inner guide vane plate in the direction of a longitudinal axis of a guide vane.

DESCRIPTION OF THE INVENTION

A section of a guide vane 10, which is inserted in a pivotable manner around a longitudinal axis A into an uptake 21 of an inner ring 20 (shown only in a section), is illustrated in a perspective illustration in FIG. 1. For better understanding, in this case, a view into the uptake 21 is shown in the illustration; the uptake is formed here as a straight circular cylinder, its central axis extending into the inner ring in the radial direction (of the inner ring).

The guide vane 10 has a vane element 11 and a guide vane plate 12. The guide vane plate 12 has a diameter D and an average thickness (or height) H (as the length of the section of the longitudinal axis A running between the cover surface and the base surface in the guide vane plate), which is smaller than the diameter. The guide vane plate further has a cover surface 14 facing the vane element 11, a base surface which is covered up in FIG. 1, and an edge surface 15 joining the cover surface and the base surface. In the example shown, the cover surface and the base surface are designed inclined relative to one another; in alternative embodiments, these surfaces can lie parallel to one another.

In a first region B1 the edge surface 15 forms a chamfer 17, in which the guide vane plate tapers in the direction to the base surface. The chamfer 16 makes possible an inclination of the guide vane relative to the uptake 21 in the inner ring 20 in the direction of the region B1 during the insertion of the guide vane plate into the uptake 21. This simplifies the threading of the guide vane, which is mounted in advance in the outer housing, into the uptake 21.

Due to the chamfer 17, a cavity 30 that promotes leakage is found, of course, between the inner wall of uptake 21 and the edge surface 15 in the region $B_1$. In order to minimize this leakage, the guide vane plate according to the invention is designed so that the edge region runs in a second region $B_2$ along a cylindrical surface. In this way, it snuggles against the correspondingly shaped wall of the uptake 21 so that the intermediate space and thus the leakage are minimized in this region.

FIG. 2 shows an alternative guide vane 10' that has a vane element 11 and a guide vane plate 12. The guide vane plate has a base surface 17 on its side facing away from the vane element 11, and FIG. 2 shows the guide vane 10' in a perspective from the base surface 17 in the direction of a longitudinal axis of the guide vane 10' (referred to an inner ring, into which the guide vane is to be inserted, thus radially outward).

An edge surface 15, which joins together the base surface 17 and the cover surface of the guide vane plate, forms a chamfer in a first region $B_1$ by which the guide vane plate 12 tapers in the direction to the base surface 17. In a second region $B_2$, in contrast, the edge surface 15 runs along a cylindrical surface. In this way, any leakage can be kept small after the guide vane plate has been inserted into a correspondingly cylindrically shaped uptake of an inner ring.

The first region $B_1$ and the second region $B_2$ form edges of sectors of the guide vane plate 12 that are different from one another. In the first region $B_1$, the edge surface has an angle of rotation $\alpha$, which is smaller than 180°; in the second region $B_2$, in contrast, the edge surface has an angle of rotation $\beta$, which is greater than 180°, wherein, in the example shown, $\beta=360°-\alpha$.

On the base surface 17 of the guide vane plate, the guide vane 10' has a bearing journal 13, which extends cylindrically in the direction of the longitudinal axis of the guide vane; in FIG. 2, only a base surface of the bearing journal can be seen due to the perspective. The diameter d thereof is smaller than the diameter D of the guide vane plate 12.

A guide vane 10, 10' according to the invention for a guide vane ring of a turbomachine has a vane element as well as a guide vane plate 12 for its support on an inner ring 20. The guide vane plate has a cover surface 14 facing the vane element, a base surface 17 lying opposite to the cover surface, and an edge surface 15 joining the cover and base surfaces. In a first region $B_1$, the edge surface forms a chamfer 16 of the vane plate, and in a second region $B_2$, which forms the edge of a sector of the guide vane plate that is different from that of the first region $B_1$, the edge surface runs along a cylindrical surface.

A method according to the invention serves for assembling a guide vane ring. It comprises an insertion of a plurality of guide vanes 10, 10' according to the invention into respective uptakes 21 in an inner ring 20. In this case, each of the guide vanes is temporarily brought into an inclined position relative to the respective uptake.

What is claimed is:

1. A guide vane of a turbomachine, comprising a vane element as well as a guide vane plate for its support on an inner ring, wherein the guide vane plate has a cover surface facing the vane element, a base surface lying opposite to the cover surface, and an edge surface joining the cover and base surfaces, wherein the edge surface forms a chamfer of the vane plate in a first region and runs along a cylindrical surface in a second region, wherein the cylindrical surface in the second region extends perpendicular to the base surface, wherein an outer circumferential edge of the cover surface defines a diameter of the guide vane plate and the chamfer extends from the outer circumferential edge of the cover surface to the base surface, the chamfer is disposed at an angle relative to the base surface that is different from an angle of the perpendicular cylindrical surface of the second region, and wherein the guide vane is inserted into an associated uptake in the inner ring and the associated uptake has a substantially uniform depth.

2. The guide vane according to claim 1, wherein the edge surface has an angle of rotation that lies in a range of 20° to 170° in the first region.

3. The guide vane according to claim 1, wherein the edge surface has an angle of rotation of at least 180° in the second region.

4. The guide vane according to claim 1, further comprising:

a bearing journal extending in a longitudinal direction of the guide vane at the base surface of the guide vane plate.

5. The guide vane according to claim 1, wherein the edge surface of the guide vane plate is snuggled flat against a wall of the associated uptake in the second region.

6. The guide vane according to claim 1, wherein the guide vane is temporarily brought into an inclined position that is inclined relative to the associated uptake during the insertion, in which the base surface of the guide vane plate of the guide vane is oblique relative to a bottom surface of the associated uptake.

7. The guide vane according to claim 6, wherein, in the inclined position, the second region of the guide vane plate, projects further into the associated uptake than the first region of the guide vane plate, in which the edge surface thereof has the chamfer.

8. The guide vane according to claim 6, wherein, in the inclined position, the first region of the guide vane plate projects further into the associated uptake than the second region of the guide vane plate.

* * * * *